US006140639A

United States Patent [19]

Gusev et al.

[11] Patent Number: 6,140,639

[45] Date of Patent: Oct. 31, 2000

[54] SYSTEM AND METHOD FOR ON-LINE COUPLING OF LIQUID CAPILLARY SEPARATIONS WITH MATRIX-ASSISTED LASER DESORPTION/IONIZATION MASS SPECTROMETRY

[75] Inventors: Arkady I. Gusev, Bluebell, Pa.; David M. Hercules, Nashville, Tenn.

[73] Assignee: Vanderbilt University, Nashville, Tenn.

[21] Appl. No.: 09/086,894

[22] Filed: May 29, 1998

[51] Int. Cl.[7] ..... H01J 49/04

[52] U.S. Cl. ..... 250/288

[58] Field of Search ..... 250/288, 281, 250/282

[56] References Cited

U.S. PATENT DOCUMENTS

| | | | |
|---|---|---|---|
| 4,267,457 | 5/1981 | Nakagawa et al. | 250/288 |
| 4,705,616 | 11/1987 | Andresen et al. | 250/288 |
| 4,820,648 | 4/1989 | Caprioli et al. | 250/288 |
| 4,908,512 | 3/1990 | Caprioli et al. | 250/288 |
| 5,449,902 | 9/1995 | Onishi et al. | 250/288 |
| 5,596,192 | 1/1997 | Waki | 250/288 |
| 5,643,800 | 7/1997 | Tarantino et al. | 436/518 |

OTHER PUBLICATIONS

"Laser Desorption Mass Spectrometry", *Methods in Enzymology*, vol. 289, Moore, 1997, pp. 520–542.

"Characterization of SDS—PAGE–Separated Proteins by Matrix–Assisted Laswer Desorption/Ionization mass Spectrometry", *Analytical Chemistry*, vol. 68, No. 6, Mar. 15, 1996, Liang et al. pp. 1012–1018.

Laser Desorption Ionizatio of Proteins with Molecular Masses Exceeding 10 000 Daltons, *Analytical Chemistry*, vol. 60, No. 20, Oct. 15, 1988, Karas et al. pp. 2299–2301.

"Improved Resolution and Very High Sensitivity in MALDI TOF of Matrix Surfaces Made by Fast Evaporation", *Analytical Chemistry*, vol. 66, No. 19, Oct. 1, 1994, Vorm et al., pp. 3281–3287.

"The Future of Mutation Detection", *Clinical Implications*, by Friedrich C. Luft, 1997, pp. 692–693.

"Matrix–Assisted Laser Desorption/Ionization Mass Spectrometry of Biopolymers", *Analytical Chemistry*, vol. 63, No. 24, Dec. 15, 1991, Hillenkamp et al., pp. 1193–1202.

"MALDI MS and Strategies for Protein Analysis", *Analytical Chemistry News & Features*, Nov. 1, 1997, Fenselau, pp. 661–665.

"Coupling Matrix–Assisted Laser Desorption/Ionization to Liquid Separations" *Mass Spectrometry Reviews* Kermit K. Murray, Dec. 10, 1997, pp. 283–299.

"A Laminar Flow Nebulizer for Aerosol MALDI", Anal. Chem, He et al. Sep. 1, 1997, pp. 3613–3616.

"Development of a Method Based on Liquid Chromatagraphy–Electrospray Mass Spectrometry for Analyzing Imidazolinone Herbcides in Environmental Water at Part—Per—Trillion Levels", *Journal of Chromatography A*, D'Ascenzo et al., 1998, pp. 104–119.

"Laser Desorption Nass Spectrometry on Thin Liquid Jets" Fresenius J. Anal. Chem., Sobott et al., Sep. 12, 1997, pp. 745–749.

*Primary Examiner*—Kiet T. Nguyen
*Attorney, Agent, or Firm*—Waddey & Patterson; Mark J. Patterson

[57] ABSTRACT

The invention relates to a system and method for on-line coupling of liquid capillary separation with matrix-assisted laser desorption ionization mass spectrometric analysis. In this system and method, analyte from liquid capillary separation is mixed with matrix molecules for matrix-assisted laser desorption ionization. Continuous flow of the analyte/matrix combined with vacuum conditions allows evaporation and crystallization of homogeneous samples on a solid sample surface. Dual use of laser irradiation to desorb/ionize and remove excess sample facilitates on-line use and automation.

31 Claims, 6 Drawing Sheets

SYSTEM AND METHOD FOR ON-LINE COUPLING OF LIQUID CAPILLARY SEPARATIONS WITH MATRIX-ASSISTED LASER DESORPTION/IONIZATION MASS SPECTROMETRY

BACKGROUND OF THE INVENTION

The present invention relates generally to methods of multidimensional chemical analysis. More specifically, the system and method of this invention pertains to on-line coupling of liquid capillary separations with mass spectrometric detection.

Most complex biomedical and environmental samples require application of complimentary mulitdimensional analysis methods to compensate for sample and matrix interferences, and to obtain efficient analyte separation/purification in order to provide reliable qualitative (molecular weight and structural elucidation) and quantitative results. Mass spectrometers have been used extensively as detectors for various separation methods. For example, gas chromatography/mass spectrometry provided a breakthrough in hyphenated methods of chemical analysis.

Until recent years, most mass spectral methods produced strong molecular fragmentation and were not applicable for analysis of complex high molecular weight compounds. The recent introduction of electrospray ionization (ESI), atmospheric pressure ionization (API), atmospheric pressure chemical ionization, and matrix assisted laser desorption ionization (MALDI) changed the status of mass spectrometry (MS). These methods provide minimal fragmentation and high sensitivity for analysis of a wide variety of fragile and nonvolatile compounds. MALDI has been applied to the analysis of peptides, proteins, lipids, oligosaccharides, oligonucleotides, dyes, and synthetic polymers. Hillencamp, et al., Anal. Chem. 63: 1193A–1202A (1991). Glycoproteins with a large proportion of carbohydrate, normally refractory to mass spectral analysis, produce intense spectra when analyzed by MALDI-MS.

MALDI is often combined with time-of-flight (TOF) mass spectrometry, providing detection of molecular mass up to 106 Da and sample size in the atomole range.

Various off-line combinations of separation techniques have been coupled with MALDI-MS analysis. Liang, et al., reported the use of sodium dodecyl sulfate polyacrylamide gel electrophoresis (SDS-PAGE) separation of proteins prior to application of the samples for evaporation and crystallization for MALDI-MS analysis. Anal. Chem. 68: 1012–1018 (1996). Rahbek-Nielsen, et al., used high performance liquid chromatography to separate peptides prior to application of peptide fractions onto a probe tip which had been precoated with matrix. J. Mass Spec. 32: 943–958 (1997). Zhang and Caprioli produced off-line coupling of capillary electrophoresis (CE) with MALDI-MS by fixing a cellulose membrane onto a polished MALDI sample plate, with the plate mounted on the moveable stage with the exit end of the capillary contacting the membrane strip. The target plate was moved 1.5 to 2.0 minutes after the start of the CE analysis and movement continued until 3.3 minutes later. During this time the stage was moved approximately 5 cm, with continuous deposition of sample along the sample track. The target plate was then removed and placed in the mass spectrometer. J. Mass. Spec. 31(9): 1039–1046 (1996).

Hahner, et al., describe using MALDI-MS for direct sequencing of RNA by enzymatically cleaving the RNA molecules prior to placing 0.6 ml aliquots of analyte solution on a flat inert metal substrate for analysis. Nuc. Acids Res. 25: 1957–1964 (1977). Beavis, et al., U.S. Pat. No. 5,288,644, describe the use of MALDI-MS with standard DNA sequencing techniques to perform DNA sequencing. The four separate collections of DNA fragments are applied to a MALDI-MS probe, along with matrix solution. The volatile solvents are then removed by room temperature evaporation before MALDI-MS analysis. Jurinke, et al., describe the use of nested PCR and MALDI-MS analysis to sequence viral DNA. Nested PCR samples are prepared from the viral DNA. Half a microliter of the PCR sample is then pipetted onto a MALDI-MS sample holder, where it is mixed with an equal volume of matrix solution and dried at ambient temperature before being placed into the mass spectrometer. Gen. Anal. Biomolecular Eng. 13: 67–71 (1996).

Each of the previously mentioned techniques, however, is limited to off-line coupling of the separation system with MALDI-MS. Preparation of sample for MALDI-MS analysis has posed problems for on-line coupling of sample preparation and analysis.

MALDI analysis is accomplished by mixing analyte with a matrix solution consisting of a suitable small organic acid, such as 2,5-dihydroxybenzoic acid or a-cyano-4-hydroxycinnamic acid, where the matrix is presumed to isolate the biopolymer molecules from each other, absorb energy from the laser light, and promote efficient analyte ionization in a gas phase. Sample preparation has been most commonly done by mixing suitable proportions of analyte and matrix solutions, then drying an aliquot of the mixture onto a probe made of a solid material such as an inert metal. MALDI sample preparation has therefore proven unacceptable for on-line use with liquid capillary separation systems.

Once the sample has been crystallized on the probe, a laser beam directed to the sample provides energy to desorb matrix and analyte and to obtain efficient ionization in a gas phase as proton transfer from the small organic acid matrix molecules to analyte molecules occurs without decomposing the analyte molecules. The host matrix is selected to absorb the radiation, and therefore the wavelength of the radiation is selected according to the absorbance characteristics of the matrix material. In a TOF mass spectrometer, the mass of the ionized analyte molecule can than be determined by the arrival time of an individual analyte ion at the detector, a function of the mass/charge ratio.

On-line coupling of separation system with MALDI-MS has been attempted using laser energy directed to an aerosol suspension of analyte/matrix molecules. This technique, however, has proven unsuccessful at providing the same quality results as solid-state sample preparation methods in off-line coupled systems.

U.S. Pat. No. 5,643,800 describes a method of off-line sample preparation to produce a more homogeneous sample, which has been shown to improve sensitivity and resolution of MALDI-TOF analysis. Anal. Chem. 66: 3281–3287 (1994). A mixture of analyte and matrix is sprayed onto a probe tip, where it is crystallized by lyophilization to form a homogeneous analyte/solvent mixture. The probe tip is then removed and placed into a mass spectrometer for analysis.

U.S. Pat. No. 5,499,902 describes an alternative means for directly connecting an analytical column with a mass spectrometer, comprising four or more trapping columns for washing, trapping, and desalting the component of interest, as well as for introducing the sample into the mass spectrometer. Although the method promotes automation of sample preparation and analysis in a mass spectrometer, the additional step of mixing analyte and matrix, followed by evaporation and crystallization of the sample on a sample probe or sample surface, would be too time-consuming for sample preparation and analysis of samples from a liquid capillary separation system.

What is needed then, and what the present invention provides, is a system and method for preparation of a homogenous sample to be deposited on a solid surface for MALDI-MS analysis which can produce sample deposit on and sample desorption/ionization from the solid surface at a rate that would allow for analysis of continuously eluting sample from a liquid capillary separation system.

SUMMARY OF THE INVENTION

The present invention is directed to a system and method for direct on-line coupling of liquid capillary separation systems with matrix-assisted laser desorption ionization (MALDI) time of flight (TOF) mass spectrometry (MS). The system includes a conduit for transporting analyte from a liquid capillary separation system that intersects with a conduit for transporting matrix material. At the point of intersection, analyte and matrix combine to be further transported to a solid surface where a pneumatic interface and vacuum conditions, with or without the addition of heat, may promote evaporation and crystallization of the analyte/matrix combination. Desorption and ionization may be accomplished by irradiation, particularly by use of a laser beam. On-line use and automation of sample analysis may be facilitated by use of higher energy Jaser irradiation to remove residual analyte/matrix material from the solid surface following irradiation of the analyte/matrix crystals, in preparation for the deposit of the next analyte/matrix sample on the solid surface.

The solid surface for sample deposit may be a frit fitted at the end of a capillary tube or the end of an open-ended capillary tube.

The invention is also directed to a system and method for analyzing eluant from multiple liquid capillary separation systems by aligning multiple analyte/matrix tubes in close proximity to one another for the purpose of using a single laser source and analysis system to desorb and ionize sample (analyte/matrix) from each individual tube, and analyze the desorbed/ionized sample, respectively.

DESCRIPTION OF THE PREFERRED EMBODIMENTS

Figure 1:
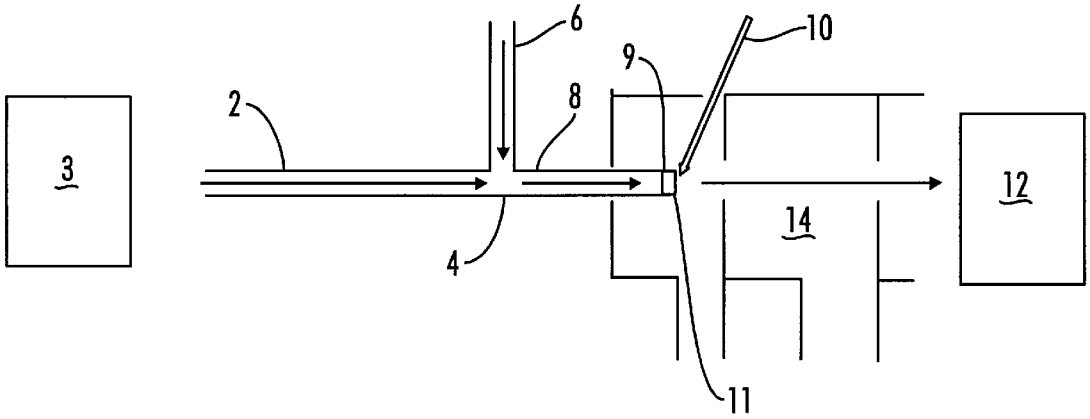
FIG. 1 schematically illustrates the design of the present system for on-line coupling of liquid capillary separation with matrix-assisted laser desorption ionization mass spectrometry.

Referring now to FIG. 1, there is shown generally the LCS/MALDI-MS on-line coupling system of the present invention. A first capillary tube 2 transporting eluant (analyte) from a liquid capillary separation system 3 is intersected at a T-connection 4 with a second capillary tube 6 transporting a solution of matrix appropriate for matrix-assisted laser desorption ionization. In a preferred embodiment of the invention, the matrix may include 2,5-dihydroxybenzoic acid, a-hydroxycinnamic acid, or other small organic acid.

Analyte and matrix mix as they enter the proximal end of a third capillary tube 8 at the T-connection 4. Mixed analyte/matrix then flows through the third capillary tube 8 to its distal end 9, where the mixture is evaporated, leaving analyte/matrix crystallized on a sample surface 11 at the distal end 9 of the third, or common, capillary tube 8. From this surface 11, the analyte/matrix crystals are desorbed and ionized by the energy from a laser beam 10 directed to the surface 11 at the distal end 9 of the third capillary tube 8. The presence of the organic acid matrix overcomes the molecular photodissociation of the analyte ions that would normally be induced by direct laser irradiation of the sample.

Once desorbed and ionized, the analyte molecules are carried by air flow through a vacuum chamber 14 to a first embodiment of a mass spectrometer 12 for analysis.

Figure 2A:
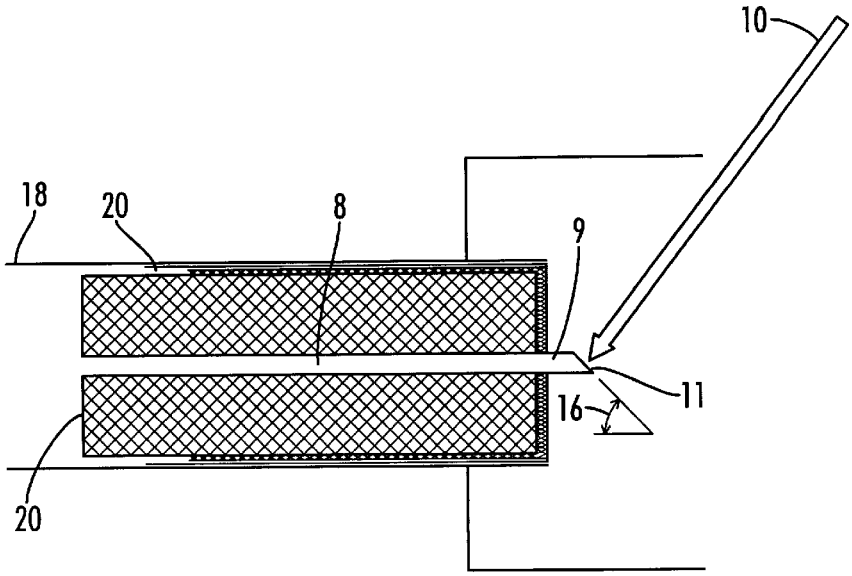
FIG. 2*a* is a longitudinal cross-section of the distal end of a first embodiment of the open-ended capillary tube shown assembly of the present invention.
Figure 2B:
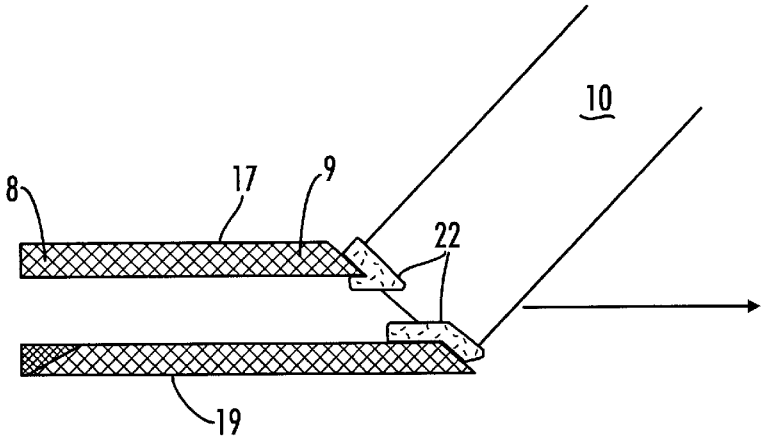
FIG. 2*b* is an enlarged longitudinal cross-sectional view of distal end of the capillary tube shown in FIG. 2*a*.
Figure 2C:
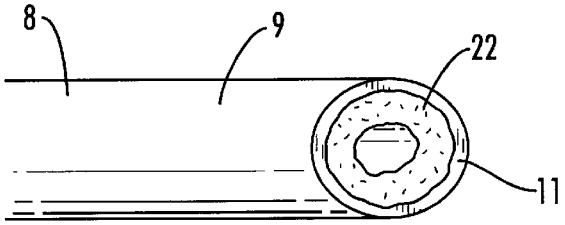
FIG. 2*c* is a plan view from above the distal end of the capillary tube shown in FIGS. 2*a* and 2*b*, showing the deposit on the interior surface of he capillary tube.

FIGS. 2*a*, 2*b*, and 2*c* illustrate the capillary tube 8 of the present system where the open end of the tube 8 serves as the sample surface 11. In FIG. 2*a*, the third capillary tube 8 is cut at an acute angle 16 to produce a shorter dorsal capillary tube surface 17 and a longer ventral capillary tube surface 19 in order to expose more of the inner surface of the tube 8 to the laser beam 10. The tube 8 is placed within a protective shield 18, and held in place by sealing material 20. As analyte/matrix flows through the third capillary tube 8, fluid is evaporated, and analyte/matrix crystals 22 are deposited at the open end of the tube 8, as shown in FIGS. 2*b* and 2*c*. Laser beam 10 is directed to this surface 11 to desorb and ionize the sample.

Continuous flow of analyte from a liquid capillary separation system 3 is analyzed on-line by desorbing and ionizing the sample with a laser beam 10 of energy in a range appropriate for the matrix chosen for MALDI-MS analysis, followed by application of a higher energy laser beam 10 to remove residual analyte/matrix crystals which were not desorbed. After removal of crystals from the previous sample by the higher energy laser beam 10, the sample surface 11 is available for the deposit of the next fraction of analyte from the liquid capillary separation system. The application of a lower energy laser beam is followed by a higher energy laser beam 10 is cycled at a sufficiently rapid rate to produce an automated sample deposit/sample analysis system with the degree of analytical accuracy expected of a solid-state sample system but not produced by aerosol sample analysis.

Figure 3A:
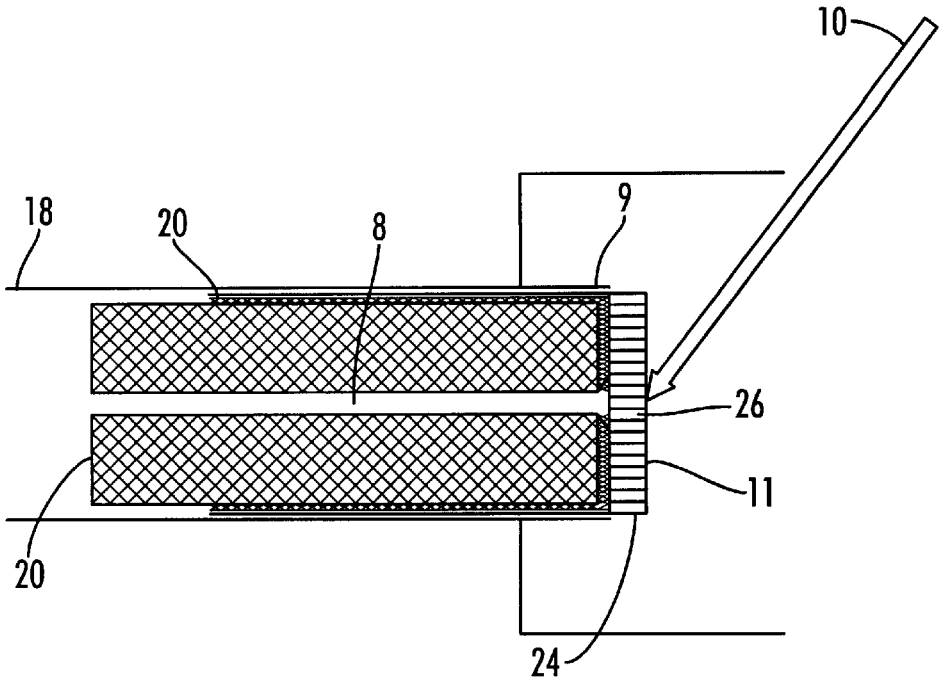
FIG. 3*a* is a longitudinal cross-section of a second embodiment of the capillary tube assembly.
Figure 3B:
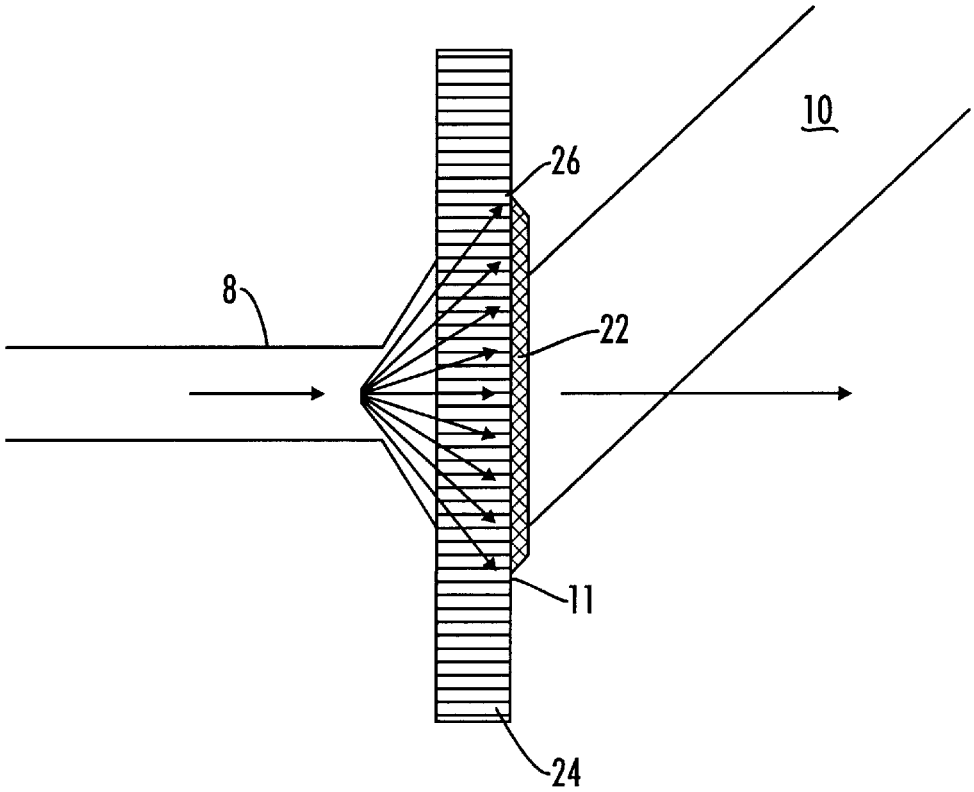
FIG. 3*b* is an enlarged longitudinal cross-sectional view of the distal end of the frit-end capillary tube assembly of FIG. 3*a*, showing the pattern of sample deposit upon the frit surface.

Referring now to FIGS. 3*a* and 3*b*, in a second preferred embodiment of the invention the sample surface 11 at the distal end 9 of the third capillary tube 8 is a porous barrier 24 attached at the end of the tube 8, as shown in FIG. 3*a*, so that analyte/matrix fluid flowing through the capillary tube 8 flows through pores 26 in the barrier 24 to be evaporated and crystallized on the sample surface 11 as shown in FIG. 3*b*. In the preferred embodiment of the invention, the porous barrier 24 is a frit composed of glass, porcelain, or metal. Analyte/matrix flows through the pores 26 of the frit 24 and accumulates on the sample surface 11 to provide a sample homogeneously distributed upon a surface 11 for laser desorption and ionization. Laser energy 10 is directed to this surface 11 to desorb/ionize the sample, with a second, higher-energy beam 10 directed to the surface 11 to remove residual analyte/matrix sample from the frit 24 surface after desorption/ionization.

Figure 4A:
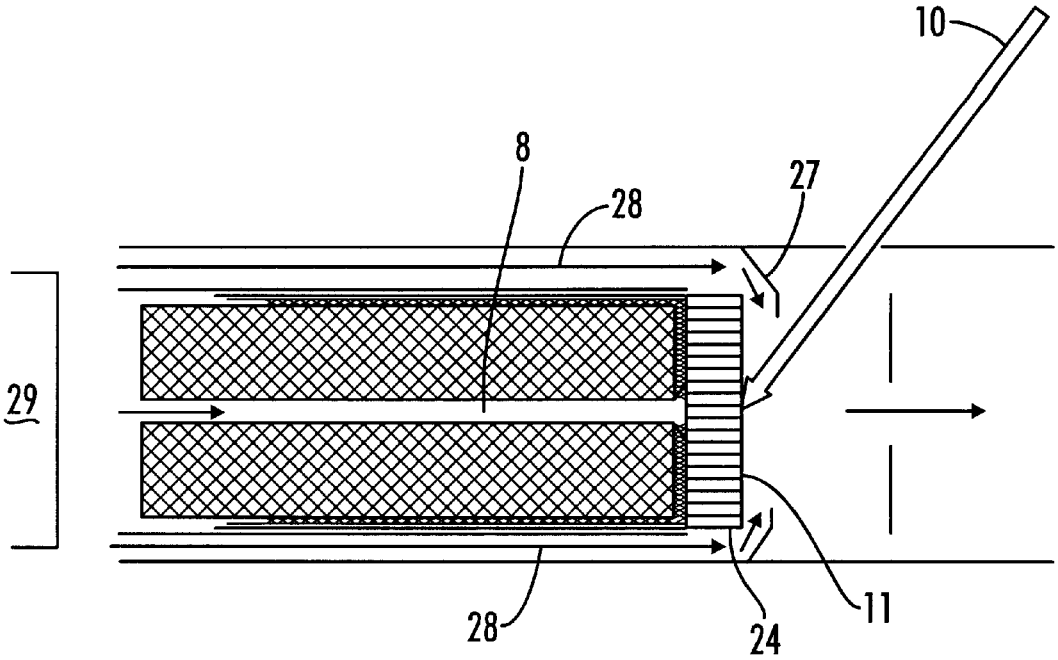
FIGS. 4*a* and 4*b* are longitudinal sections of a third embodiment of the frit-end capillary tube assembly (4*a*) and open-end capillary tube assembly (4*b*) provided with a pneumatic interface to promote evaporation upon the sample surface at the capillary end.
Figure 4B:
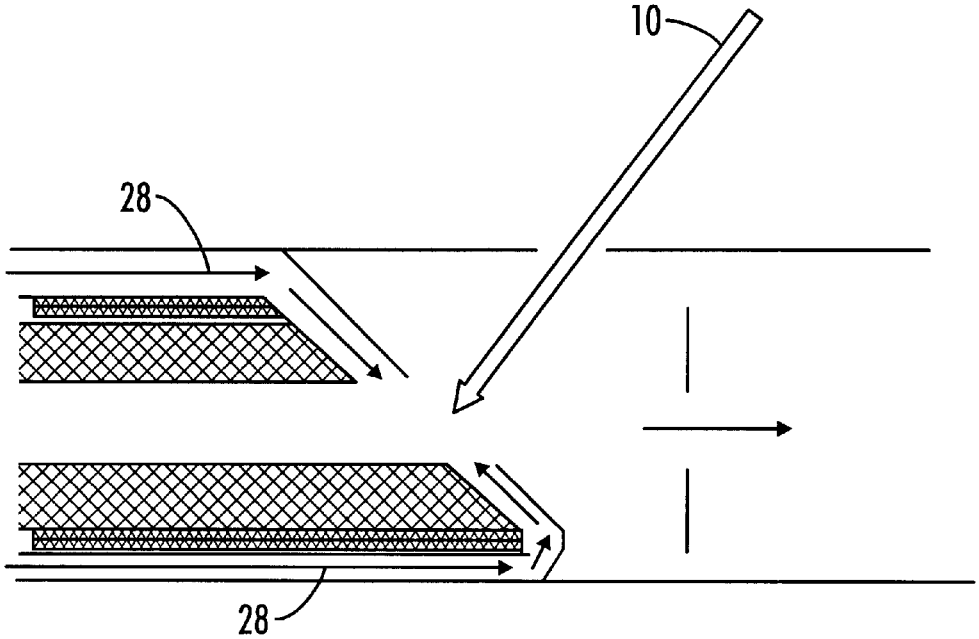

Referring now to FIGS. 4*a* and 4*b*, in a third preferred embodiment of the present invention a pneumatically-assisted interface 27 provides airflow 28 around the end of the third capillary tube 8 to promote evaporation and crystallization of the sample on the surface 11 of the frit 24, as in FIG. 4*a*, or the open-ended capillary tube 8, as in FIG. 4*b*. A heating element 29 may provide warm air to increase the rate of evaporation, particularly when the solvent is non-volatile.

Figure 5:
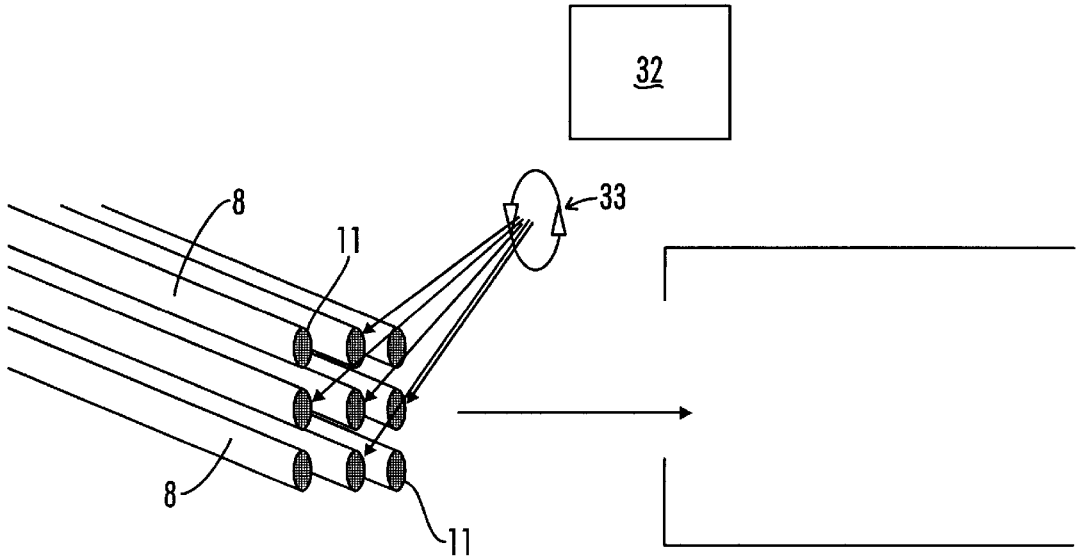
FIG. 5 is a schematic of the placement of a plurality of analyte/matrix tubes to facilitate analysis of samples from multiple liquid capillary separation systems using a single mass spectrometer and a rastering laser beam.

A particular advantage of the automated sample preparation/analysis provided by the present invention is shown in FIG. 5. Multiple third capillary tubes 8 from multiple liquid capillary separation system 3 (FIG. 1) may be arranged in an array such as that shown in FIG. 5. Laser energy from laser source 32 is then directed to each of the sample surfaces 11 at the ends of the individual analyte/matrix capillary tubes 8 by means of a rastering laser beam 33. Laser source 32 is programmed to deliver alternating lower energy beams to desorb/ionize the sample from the surfaces 11 at the end of each analyte/matrix tubes 8 with higher energy laser beams to remove excess analyte from each of the sample surfaces 11.

Figure 6:
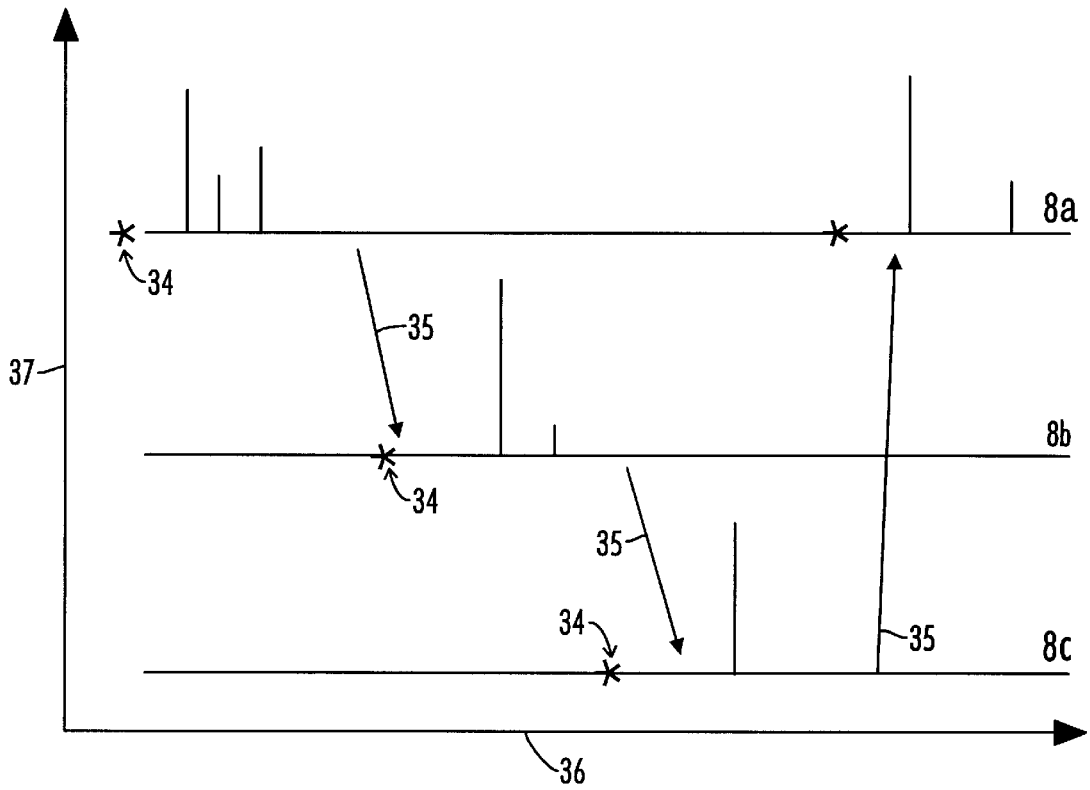
FIG. 6 is a time diagram illustrating the timing of the laser beam in relation to the switching of the capillary channels for mass spectral analysis and recording.

As shown in FIG. 6, where horizontal axis 36 represents time and vertical axis 37 represents relative units of signal intensity, timing of the laser shot 34 to each of the sample surfaces 11 is staggered so that MALDI-MS analysis for each of the individual third capillary tubes 8*a, b, c* may be performed by a single mass spectrometer. Samples from individual tubes 8*a, b, c* can be sorted for recording by switching the channels 35 for each of the tubes 8 after firing the laser for that particular analyte/matrix capillary tube.

Thus, although there have been described particular embodiments of the present invention of a new and useful Apparatus and Method for On-line Coupling of Liquid Capillary Separations With Matrix-Assisted Laser Desorption/Ionization Mass Spectrometry, it is not intended that such references be construed as limitations upon the scope of this invention except as set forth in the following claims.

What is claimed is:

1. A system for on-line coupling of a liquid capillary separation system to a matrix source to perform matrix-assisted laser desorption ionization comprising:

a. a first fluid conduit fluidly connected to the liquid capillary separation system;

b. a second fluid conduit fluidly connected to the matrix source, said first and second fluid conduits fluidly intersecting proximally into a third common fluid conduit where analyte from the liquid capillary separation system and matrix from the matrix source mix to form an analyte/matrix sample, said third common fluid conduit having an open distal end terminating at a sample surface on which said analyte/matrix sample is evaporated to form analyte/matrix crystals; and c. an irradiation source positioned to deliver a sequence of bursts of laser energy to said sample surface at a lower energy level to desorb and ionize at least some of the analyte/matrix crystals and at a higher energy level to remove any residual analyte/matrix crystals from the sample surface, thereby providing for a continuous flow and sampling of the analyte through the system for purposes of mass spectrometry.

2. The system as in claim 1, wherein said sample surface comprises an interior surface of the open distal end of the third common fluid conduit.

3. The system as in claim 2, wherein said open distal end of the third common fluid conduit is dissected at an acute angle to define a longer ventral portion and a shorter dorsal portion on said open distal end, the longer ventral portion providing an increased surface area for sample deposit and irradiation.

4. The system as in claim 1, wherein the sample surface comprises a porous barrier attached to said open distal end of said third common fluid conduit.

5. The system of claim 4, wherein said porous barrier comprises a frit.

6. The system of claim 5, wherein said frit comprises glass.

7. The system of claim 5, wherein said frit comprises porcelain.

8. The system of claim 5, wherein said frit comprises stainless steel.

9. The system of claim 1 further comprising a pneumatic interface to provide dry gas flow to promote evaporation of fluid and crystallization of analyte/matrix on said sample surface.

10. The system of claim 1 further comprising a heating element positioned to provide warmed gas flow to promote evaporation of fluid and crystallization of analyte/matrix on said sample surface.

11. The system of claim 1 further comprising a means to transmit ionized particles from the sample surface to a particle analysis system.

12. The system of claim 11, said means to transmit ionized particles from the sample surface to a particle analysis system comprising ambient airflow.

13. The system of claim 11, wherein said particle analysis system comprises a mass spectrometer.

14. A method for combining a plurality of liquid capillary separation systems with sample analysis at a mass spectrometer, comprising:

a. arranging in close proximity a plurality of capillary tubes transporting mixed analyte/matrix from a plurality of liquid capillary separation systems;

b. depositing the mixed analyte/matrix on a plurality of sample surfaces aligned at distal ends of said capillary tubes;

c. evaporating the mixed analyte/matrix on the sample surfaces to form analyte/matrix crystals;

d. sequentially directing a rasterizing laser beam to each of said sample surfaces to desorb and ionize at least some of the analyte/matrix crystals; and e. sequentially directing the rasterizing laser beam at each of said sample surfaces to remove any residual analyte/matrix crystals and providing for a continuous flow and sampling of analyte through the system for purposes of mass spectrometry.

15. A method for on-line coupling of a liquid capillary separation system with matrix-assisted laser desorption/ionization mass spectrometry comprising:

a. a first step of mixing analyte and matrix in a capillary tube to form an analyte/matrix sample;

b. a second step of evaporating and crystallizing the analyte/matrix sample on a sample surface at an open distal end of said capillary tube to form analyte/matrix crystals;

c. a third step of directing a laser irradiation source to the sample surface at a first energy level for desorbing and ionizing at least some of the analyte/matrix crystals for mass spectral analysis, and;

d. a fourth step of directing a laser irradiation source to the sample surface at a second energy level for removing residual analyte/matrix crystals from the sample surface.

16. The method of claim 15 wherein the analyte and matrix are mixed by intersecting a first capillary conduit transporting analyte from the liquid capillary separation system with a second capillary conduit transporting the matrix from a matrix source.

17. The method of claim 15 wherein evaporation and crystallization of the analyte/matrix sample on the sample surface is enhanced by a dry gas flow provided by a pneumatic interface.

18. The method of claim 17 wherein evaporation and crystallization of the analyte/matrix sample on said sample surface is enhanced by the addition of heat.

19. The method of claim 15 wherein the sample surface comprises an interior surface of the open distal end of the capillary tube.

20. The method of claim 19 wherein said open distal end is dissected at an acute angle, said distal end thereby comprising a longer ventral portion and a shorter dorsal portion, the longer ventral portion providing an increased surface area for sample deposit and irradiation.

21. The method of claim 20 wherein the sample surface further comprises a porous barrier attached to said open distal end of said capillary tube.

22. The method of claim 21 wherein said porous barrier comprises a frit.

23. The method of claim 22 wherein said frit comprises glass.

24. The method of claim 22 wherein said frit comprises porcelain.

25. The method of claim 22 wherein said frit comprises stainless steel.

26. A sample coupling system for matrix-assisted laser desorption/ionization mass spectrometry comprising:

a. a matrix tube connected to transport matrix from a matrix source;

b. a first analyte tube connected to transport analyte from a first analyte source;

c. a first sample tube having a proximal section connected to the matrix tube and to the analyte tube and adapted for receiving and mixing the matrix with the analyte from the first analyte source to form a first analyte/matrix sample;

d. a first sample surface proximate a distal end of the first sample tube and adapted to receive and evaporate the first analyte/matrix sample thereby forming first sample crystals on the first sample surface; and e. a source of laser radiation sequentially emitting a laser beam to the first sample surface at a first energy level to desorb and ionize at least some of the first sample crystals and at a second energy level to remove any residual first sample crystals, thereby providing for a continuous flow and sampling of the first analyte through the system for purposes of mass spectrometry.

27. The system of claim 26 further comprising:

a. a second analyte tube connected to transport analyte from a second analyte source;

b. a second sample tube having a proximal section connected to the matrix tube and to the second analyte tube and adapted for receiving and mixing the matrix with the analyte from the second analyte source to form a second analyte/matrix sample;

c. a second sample surface proximate a distal end of the second sample tube and adapted to receive and evaporate the second analyte/matrix sample thereby forming second sample crystals on the second sample surface, the second sample surface arrayed proximate the first sample surface; and d. the laser beam emitted by the source of laser radiation comprising a rasterizing laser beam adapted to move to the second sample surface after the first sample surface, at a first energy level to desorb and ionize at least some of the second sample crystals and at a second energy level to remove any residual second sample crystals, thereby providing for a continuous flow and sampling of the second analyte through the system for purposes of mass spectrometry.

28. The system of claim 27 wherein the first and second sample surfaces comprise respective interior surfaces of the distal ends of the first end second sample tubes.

29. The system of claim 26 wherein the distal end of the first sample tube terminates at an acute angle to define a longer ventral portion and a shorter dorsal portion, the longer ventral portion providing an increased surface area for sample deposit and irradiation.

30. The system of claim 26 wherein the first sample surface comprises a porous barrier.

31. The system of claim 30 wherein the porous barrier comprises a frit.

* * * * *